United States Patent [19]

Musselman

[11] 4,446,398

[45] May 1, 1984

[54] VIBRATION INHIBITING MESH ASSEMBLY FOR A PICK-UP TUBE

[75] Inventor: Elvin M. Musselman, Ronks, Pa.

[73] Assignee: RCA Corporation, New York, N.Y.

[21] Appl. No.: 316,313

[22] Filed: Oct. 29, 1981

[51] Int. Cl.[3] ..... H01J 29/02; H01J 1/90

[52] U.S. Cl. ..... 313/390; 313/259; 313/269

[58] Field of Search ..... 313/383, 390, 376, 378, 313/259, 348, 269

[56] References Cited

U.S. PATENT DOCUMENTS

| | | | |
|---|---|---|---|
| 3,196,307 | 7/1965 | Lewis | 313/348 |
| 3,202,857 | 8/1965 | Antoniades | 313/89 |
| 3,237,044 | 2/1966 | Mitchell | 313/269 |
| 3,906,278 | 9/1975 | Horton et al. | 313/383 |
| 4,169,986 | 10/1979 | Stelwagen et al. | 313/383 |
| 4,323,814 | 4/1982 | Benner et al. | 313/390 |
| 4,347,459 | 8/1982 | Benner | 313/383 |

*Primary Examiner*—Palmer C. Demeo
*Assistant Examiner*—Sandra L. O'Shea
*Attorney, Agent, or Firm*—Eugene M. Whitacre; Dennis H. Irlbeck; Vincent J. Coughlin, Jr.

[57] ABSTRACT

A television pick-up tube includes a mesh assembly comprising a pair of superimposed support members having mutually adjacent support surfaces with a mesh electrode secured therebetween. Each of the support members has a centrally disposed aperture therethrough. The apertures are of a different size so that a portion of the support surface of one of the support members extends radially inwardly of the aperture in the other support member. The radially inwardly extending portion of the support surface has a fusion-resistant film of material thereon to prevent the mesh electrode from sticking thereto during the mesh assembly procedure. A method for forming the fusion-resistant film is also disclosed.

6 Claims, 3 Drawing Figures

VIBRATION INHIBITING MESH ASSEMBLY FOR A PICK-UP TUBE

BACKGROUND OF THE INVENTION

This invention relates to television pick-up tubes and particularly to an improved mesh assembly having reduced microphonics for such a tube.

Microphonics is a physical vibration of some portion of a tube which, because of its movement, produces an undesirable electrical signal output or noise which manifests itself as a background of lines or striations in a television picture.

In a vidicon type pick-up tube, a mesh grid is disposed between a photoconductive target and an electron gun which provides a scanning electron beam. The mesh provides a lens action which causes the electron beam from the electron gun to impinge perpendicularly on the target electrode. The mesh is usually supported around its periphery by at least one annular support ring.

When such tubes are subjected to mechanical shock and vibration, for example, from cooling fans or incident sound from external sources, the conductive mesh will start vibrating relative to the photoconductive target and will cause microphonic effects which produce the above-described background lines and striations in the picture.

Many expedients such as rectangularly-shaped damping members in contact with the mesh have been adopted to eliminate the undésirable microphonic effects. Such configurations provide a rectangularly-shaped raster format and thus limit the orientation of the tube within a multitube color camera thereby complicating the tube alignment procedure. Among the other expedients adopted is a structure described in U.S. Pat. No. 3,906,278 to Horton et al., issued Sept. 16, 1975 comprising a fine flexible mesh washer clamped between two annular members. The annular members are dished away from each other beyond the region of clamping. The flexible mesh washer extends inwardly beyond the region of clamping and contacts both the fine conductive mesh and the dished portion of one of the clamping members in order to damp vibrations. The Horton et al. structure is complex and requires a precisely-formed flexible mesh washer. If the corrugations of the mesh washer are too shallow, the washer will not contact both the dished annular member and the fine mesh. If this occurs, little or no damping will occur. Being constructed from mesh, the flexible washer also tends to undergo a change in elasticity after repeated thermal and mechanical cycling thus decreasing the effectiveness of the damping action.

A simple mesh damping structure is described in U.S. Pat. No. 4,323,814 issued to Benner et al. on Apr. 6, 1982, and entitled, "MESH ASSEMBLY HAVING REDUCED MICROPHONICS FOR A PICK-UP TUBE". The Benner et al. patent is assigned to the same assignee as the present invention and is incorporated by reference herein for disclosure purposes.

The Benner et al. structure comprises a mesh electrode disposed between a frustro-conically-shaped mesh support ring and a dished, i.e., frustro-conically-shaped, spring-like mesh damping ring. The mesh damping ring is compressed into a reversal of its dished shape and welded at a plurality of points to the outer periphery of the mesh support ring. By reversing the dished shape of the mesh damping ring, the damping ring assumes an undulatory or serpentine configuration which contacts the mesh electrode periodically around the inner periphery of the damping ring. The area of contact extends radially outward from the inner periphery to the weld points at the outer periphery of the damping ring.

An improved mesh damping structure is described in U.S. Pat. No. 4,347,459 issued to T. E. Benner on Aug. 31, 1982 and entitled, "IMPROVED MESH ASSEMBLY HAVING REDUCED MICROPHONICS FOR A PICK-UP TUBE". The Benner patent; and is assigned to the same assignee as the present invention and is incorporated by reference herein for disclosure purposes.

The Benner structure comprises a mesh electrode disposed between an annular support ring and an annular damping ring having a substantially bow-shaped cross-section extending from the inner periphery to the outer periphery thereof. A plurality of arcuately-shaped regions are formed into the inner periphery of the damping ring so that when the damping ring contacts the mesh electrode, a vibration damping chamber is formed in the annular region between the inner and outer periphery of the bow-shaped damping ring and the axially-extending region between the damping ring and the mesh electrode.

Both the Benner et al. and the Benner structures disclosed in the above-indicated patents require properly tempered, accurately manufactured mesh assemblies to ensure proper vibration damping.

A simpler mesh damping structure known in the art comprises a mesh electrode disposed between a pair of mounting rings having different inside diameters. In this structure, the frequency of the mesh vibration in one direction is different from that in the opposite direction. The frequency difference dissipates energy by destruction interference and thereby decreased vibration time. Unfortunately, it is necessary to heat the mesh and the mounting rings to a high temperature, subsequent to mounting the mesh electrode between the mounting rings, in order to clean and tighten the mesh. Frequently during the heating step, the mesh fuses to the surface of the mounting ring having the smaller inside diameter thus producing a structure that has the same vibrational frequency in each of the above-described opposite directions.

SUMMARY OF THE INVENTION

A pick-up tube includes a mesh assembly comprising a pair of superimposed support members having mutually adjacent support surfaces with a mesh electrode secured therebetween. Each of the support members has a centrally disposed aperture therethrough. Each of the apertures is of a different size so that a portion of said adjacent support surface of one of said support members extends radially inwardly of said aperture in the other of said support members. The radially inwardly extending portion of said support surface has a fusion-resistant material thereon.

DETAILED DESCRIPTION OF THE PREFERRED EMBODIMENT

Figure 1:
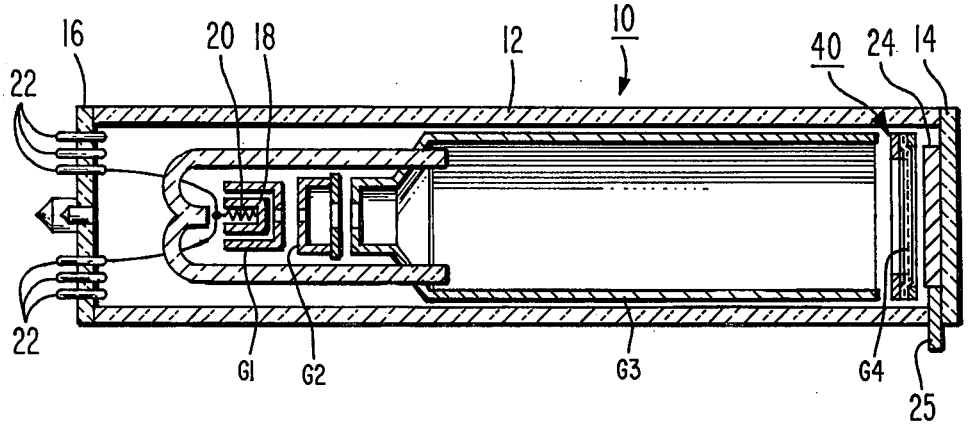
FIG. 1 is a cross-sectional view of a pick-up tube showing the novel mesh assembly structure.

Referring to the drawings, there is shown in FIG. 1 a vidicon type pick-up tube 10 having a generally cylindrical glass envelope 12 closed at one end by a transparent glass faceplate 14 and at the other end by a glass base 16. The interior of the enclosed envelope 12 is suitably evacuated.

The tube 10 comprises a cathode 18 which is heated by a filament 20. The filament is suitably connected to two of a plurality of lead pins 22 which are vacuum sealed through the base 16. G1, G2, G3 and G4 are the normally provided electrodes known under those designations. A target 24 comprises a photoconductive layer of, for example, lead monoxide, selenium-arsenic-tellurium or another suitable material well known in the art. The photoconductive layer is deposited on a film of conductive tin oxide (not shown) on the inside portion of the faceplate 14. An electrical contact is made to the target 24 by a connector 25. The connector 25, typically a tab or strip of metal such as platinum or indium, is connected to the target 24 and extends through the glass envelope 12 in a vacuum seal to make an external electrical connection.

As so far described, the pick-up tube is known, per se. In such a prior art structure, the G4 electrode is a fine conductive mesh or gauze made of electroformed copper or nickel. The G4 electrode includes about 1000 wires per inch in mutually orthogonal relation. This results in grid openings of about 0.0005 inch (12×12 microns). The thickness of the grid is about 0.0002 inch (5 microns). The G4 electrode includes a support structure which may be formed of at least one but preferably two support rings. The support rings consists of chromium-nickel alloy when copper mesh is used and molybdenum, tantalum or Nichrome when nickel mesh is used. The mesh electrode is stretched tautly between the support rings and welded thereto.

According to the present novel structure, the G4 electrode assembly 40 is modified to provide a structure having reduced microphonics without costly or complex damped spring structures and with a reproducibility of performance not achieved in the prior art. It has been found that the resonant frequency of a mesh electrode 42, shown in exaggerated thickness in FIGS. 2 and 3, may be altered and the microphonics decreased by uniformly retaining and supporting the mesh electrode 42 between a rigid annular mesh support ring 44 having a novel fusion-resistant material on a portion thereof and a rigid annular mesh retaining ring 46. The retaining ring 46 is secured to the mesh electrode 42 and to the mesh support ring 44 by welding around the outer periphery of the rings.

Figure 2:
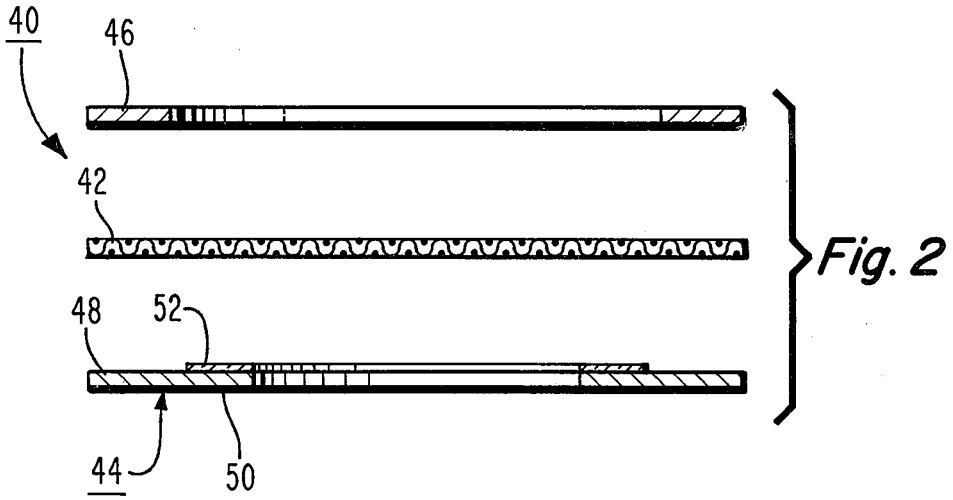
FIG. 2 is an enlarged exploded side view of the mesh assembly of FIG. 1.
Figure 3:
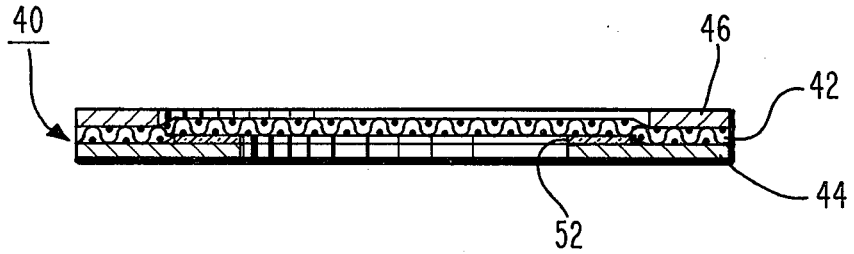
FIG. 3 is an enlarged side view of the mesh assembly of FIG. 1.

The mesh electrode 42 is electroformed by a method well known in the art to have the desired mesh size described above. The mesh electrode 42 may be circumscribed by a solid nonapertured annular portion (not shown) in order to provide increased weldability. As shown in FIGS. 2 and 3, the G4 electrode assembly 40 is formed by stretching the mesh electrode 42 taut and disposing it between the support ring 44 and the retaining ring 46 so that the mesh electrode 42 is adjacent to a fusion-resistant aluminum oxide film 52 on a support surface 48 of the ring 44. The mesh assembly 40 is then welded around its periphery to secure the mesh electrode 42 between the rings 44 and 46, respectively. Subsequent to electroforming and mounting, the electrode assembly 40 is fired in wet hydrogen at 720° C. for 20 minutes to remove surface contamination from the mesh and to tighten the mesh electrode 42.

The annular mesh support ring 44, which may alternatively be a rectangular mask, has a thickness of about 0.020 inch (0.508 mm), an inside dimension of about 0.45 inch (11.4 mm) and an outside diameter of about 0.875 inch (22.2 mm). The annular support ring 44 has two substantially flat opposing support surfaces 48 and 50, respectively. A thin film of a fusion-resistant material 52, for example, aluminum oxide, is provided on a portion of one of the support surfaces, for example, support surface 48, to prevent fusion of the mesh electrode 42 to the support surface 48 of the annular support ring 44.

The retaining ring 46 has a thickness of about 0.005 inch (0.13 mm), an inside diameter of about 0.75 inch (19 mm) and an outside diameter substantially equal to the outside diameter of the support ring 44.

In the preferred embodiment, the aluminum oxide film is formed on the support surface 48 of the support ring 44 by first masking the outer periphery of the support surface 48. The masked portion of the support surface 48 should circumscribe an annulus having slightly less than the radial dimension of the retaining ring 46. Then, a film of aluminum metal is uniformly evaporated, in vacuum, on the unmasked portion of the support surface 48. The evaporation of metal films is well known in the art and need not be described. The thickness of the aluminum film should be within the range of about 500 to 1000 Å. Next, the support ring 44 having the annular film of aluminum on a portion of the support surface 48 thereof is exposed to air to permit the aluminum film to oxide and form the aluminum oxide film 52. The aluminum oxide film 52 extends from the inner periphery of the support ring 44 radially outwardly to a diameter preferably less than the inside diameter of the annular retainer ring 46. The fusion-resistant aluminum oxide film 52 prevents the mesh electrode 42 from sticking to the support surface 48 of the support ring 44 during the above-described firing step.

What is claimed is:

1. In a pick-up tube having an evacuated envelope, a faceplate at one end of said envelope, a target electrode adjacent to said faceplate, a cathode in the other end of said envelope and a mesh assembly disposed in spaced relation adjacent to said target electrode, between said target electrode and said cathode, the improvement wherein said mesh assembly comprises a mesh electrode disposed between an annular support ring having an inside diameter, $d_1$, and an outside diameter, $d_2$, and an annular retaining ring having an inside diameter, $d_3$, wherein $d_3$ is greater than $d_1$ but less than $d_2$, said annular support ring having a support surface facing said mesh electrode, said support surface having a fusion-resistant material thereon in contact with said mesh electrode.

2. The pick-up tube as in claim 1 wherein said fusion-resistant material extends from said inside diameter, $d_1$, to less than about said outside diameter, $d_2$, on said support surface of said annular support ring.

3. The pick-up tube as in claim 2 wherein said fusion-resistant material extends between $d_1$ and less than about $d_3$ on said support surface of said annular support ring.

4. The pick-up tube as in claim 3 wherein said fusion-resistant material is substantially uniformly disposed on said support surface.

5. The pick-up tube as in claim 4 wherein said fusion-resistant material has a thickness ranging from about 500 to about 1000 Å.

6. The pick-up tube as in claims 2 wherein said fusion-resistant material comprises an oxidized aluminum film.

* * * * *